United States Patent [19]

Creager

[11] 4,012,631

[45] Mar. 15, 1977

[54] TREE LIGHTING ASSEMBLY

[76] Inventor: James J. Creager, 12000 Tollhouse Road, Clovis, Calif. 93612

[22] Filed: May 12, 1975

[21] Appl. No.: 576,438

[52] U.S. Cl. ..... 240/10 T; 240/10 Q

[51] Int. Cl.[2] ..... A47G 33/10; A47G 33/16

[58] Field of Search ..... 240/10 Q, 10 S, 10 T

[56] References Cited

UNITED STATES PATENTS

| | | | |
|---|---|---|---|
| 2,201,045 | 5/1940 | Lundstrom | 240/10 T |
| 2,205,496 | 6/1940 | Schneider | 240/10 T |
| 2,402,766 | 6/1946 | Moore | 240/10 T |
| 2,558,029 | 6/1951 | Wood | 240/10 T |
| 2,875,421 | 2/1959 | Jordan | 240/10 T |
| 3,214,579 | 10/1965 | Pacini | 240/10 T |

*Primary Examiner*—Russell E. Adams, Jr.
*Attorney, Agent, or Firm*—Huebner & Worrel

[57] ABSTRACT

A tree lighting assembly having a central electric conductor with an end adapted for connection to a source of electrical energy, a plurality of secondary electric conductors connected to the central electric conductor in spaced relation and individually having bifurcated distal portions, lights borne by the distal portions, and fasteners affixed on the lights having individual ornament attaching portions.

1 Claim, 5 Drawing Figures

TREE LIGHTING ASSEMBLY

BACKGROUND OF THE INVENTION

1. Field Of The Invention

The present invention relates to a tree lighting assembly and more particularly to such an assembly which is adapted significantly to improve the facility with which ornamental decorations can be assembled on trees, such as Christmas trees, which inherently retains nonornamental structures, such as electric wires, in positions of low visibility so as not to detract from the overall ornamental appearance of the decorated tree and which has still further ornamental and functional value in its incorporation of fastening attachments which are shaped to provide a decorative appearance while acting as a means of attachment for ornaments.

2. Description Of The Prior Art

The prior art in the area of electrical tree ornamentation is surfeited with cumbersome, difficult to install assemblies which frequently detract from, as much as they enhance, the decorative effect produced when mounted on a tree. Typically, such assemblies utilize circular conductors which must be draped about the tree in combination evenly to display the lights thereof. Such construction inherently requires that the circular conductors be visible since they are disposed in approximate coincidence with the periphery of the tree. Furthermore, no provision is made for mounting other ornamentation thereon.

Such prior art references as the Hessel U.S. Pat. No. 1,744,383; the Lundstrom U.S. Pat. No. 2,201,045; the Moore U.S. Pat. No. 2,402,766; the Cohen U.S. Pat. No. 2,533,222; the Jordan U.S. Pat. No. 2,875,421; the Pacini Pat. No. 3,214,579; and the Schlangen U.S. Pat. No. 3,321,730 disclose lighting devices intended to alleviate some of these deficiencies by mounting the wiring in areas of low visibility. However, such prior art devices are subject to other deficiencies, both functional and ornamental, which the tree lighting assembly of the present invention has overcome.

It has long been known that it would be desirable to have a tree lighting assembly which is of dependable yet economical construction, greatly facilitates mounting on a tree, inherently disposes the electrical wiring in areas of low visibility, evenly distributes the lights on the tree and incorporates ornamental yet functional components for the support of other ornamentation.

SUMMARY OF THE INVENTION

Therefore, it is an object of the present invention to provide an improved tree lighting assembly.

Another object is to provide such an assembly which is adapted significantly to improve the facility with which ornamental decorations can be mounted on a tree.

Another object is to provide such an assembly which inherently requires that the electrical wiring thereof substantially conform to the trunk and branch portions of the tree so as to be rendered nearly invisible thereby, but which has bifurcated distal portions individually mounting lights thus permitting the lights to be displayed at or near the periphery of the tree and evenly distributed thereabout.

Another object is to provide such an assembly which requires only one such assembly for decoration of a tree.

Another object is to provide such an assembly which can be manufactured in substantially coplanar relation but which, when mounted on a tree, disposes the lights thereof in evenly disposed relation about the periphery of the tree.

Another object is to provide such an assembly which has lights mounting proximal attaching portions and distal ornament supporting portions.

Another object is to provide such an assembly in which the attaching portions mount the lights in close association with their supporting branches to obscure the attaching portions thereof and which dispose the distal portions thereof beneath the branches in areas of low visibility, but appropriate for the suspension of ornaments therefrom.

Another object is to provide such an assembly which has a portion particularly well adapted for lighting of the crown portions of trees.

Further objects and advantages are to provide improved elements and arrangements thereof in an assembly for the purposes described which is dependable, economical, durable and fully effective in accomplishing its intended purposes.

DESCRIPTION OF THE PREFERRED EMBODIMENT

Figure 1:
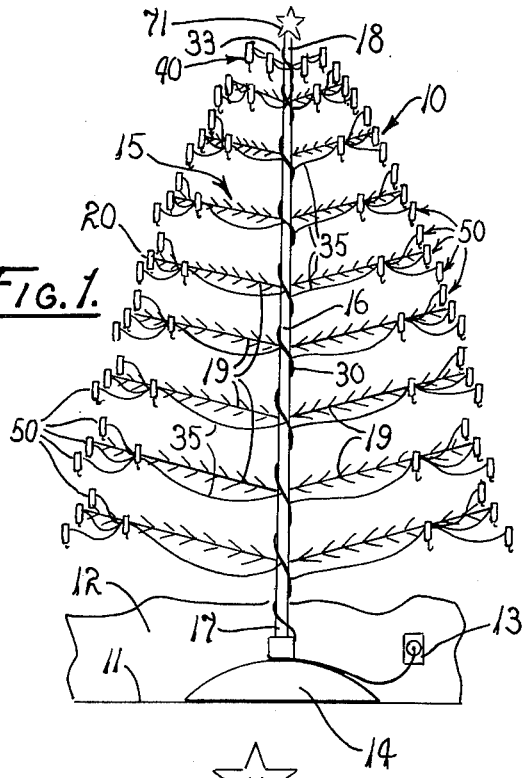
FIG. 1 is a side elevation showing the tree lighting assembly of the present invention mounted in a typical operative environment.

The tree lighting assembly of the present invention is generally indicated by the numeral 10 in FIG. 1. The assembly is shown therein in a representative operative environment in which a floor surface 11 adjoins a wall 12 which mounts a conventional electric outlet 13. A tree stand 14 is shown in rested engagement on the floor surface and mounts a tree 15 in an erect attitude thereon. The tree has a trunk 16 having a base portion 17 and an opposite crown or upper portion 18. As shown in FIG. 1, a plurality of branches 19 are laterally extended from the trunk to define a periphery 20 for the tree.

Figure 2:
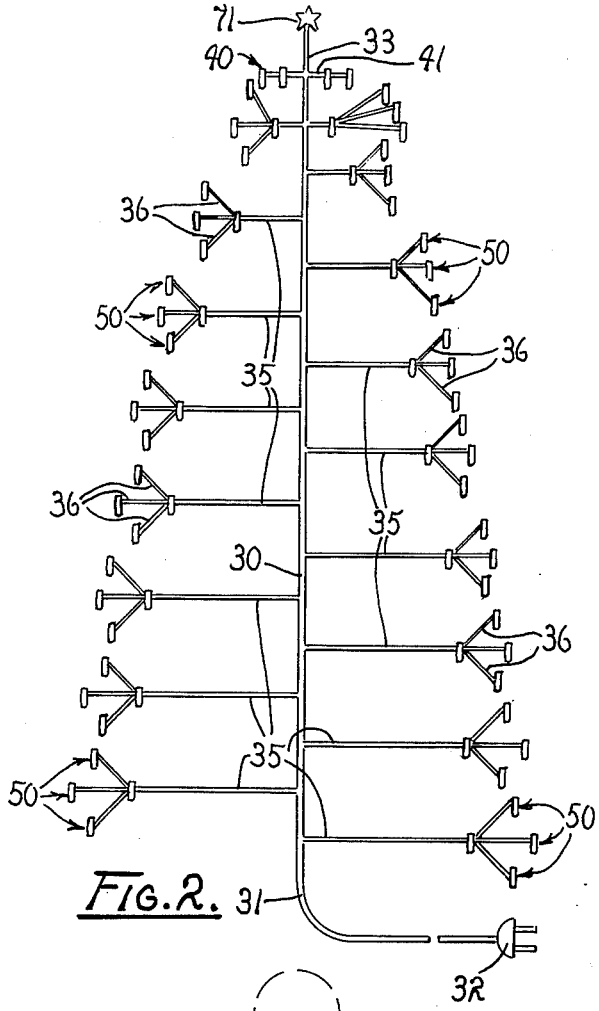
FIG. 2 is a plan view of the tree lighting assembly.

As best shown in FIG. 2, the tree lighting assembly has suitably insulated central electric cord or conductor 30 having a lead end portion 31 mounting an electric plug 32. The central electric cable or conductor has a remote end portion 33. A pair of electrically conductive primary conductors or wires 34 are extended through the length of the central electric conductor and wired to the plug permitting the plug to be inserted in any conventional electric outlet, such as outlet 13, to allow electrical current to flow along the wires from the outlet. The central electric conductor is of flexible construction permitting it to be wound about the trunk 16 of the tree, as will hereinafter be described.

Figure 3:
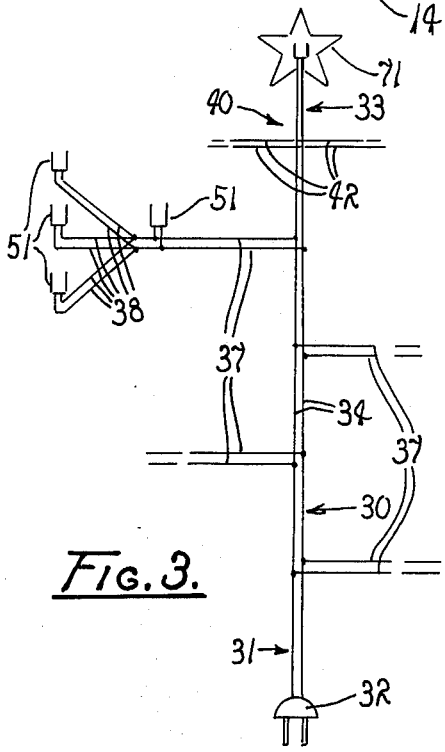
FIG. 3 is a fragmentary schematic diagram of the electrical circuit for the assembly.

A plurality of lateral secondary electric cables or conductors 35 are connected to the central electric conductor 30, extend laterally therefrom and are disposed in substantially coplanar relation with the central electric conductor. The secondary electric conductors are of flexible suitably insulated construction and are of varied lengths becoming progressively, but gradually shorter toward the remote end portion of the central electric conductor. As can best be seen in FIG. 2, the secondary electric conductors are disposed in staggered substantially equally spaced relation along a substantial length of the central electric conductor leaving the lead end portion 31 thereof free for extension to an outlet. The secondary electric conductors have individually branched or bifurcated distal portions 36 spaced from the central electric conductor. Each of the secondary electric conductors has a pair of electrical conductors or wires 37 extended therethrough and wired to the wires 34 of the central electric conductor in parallel, as shown in FIG. 3. Similarly, the bifurcated distal portion of each secondary electric conductor has pairs of electrically conductive wires 38 extending therethrough and wired to the wires of their respective secondary electric conductor in parallel.

Figure 4:
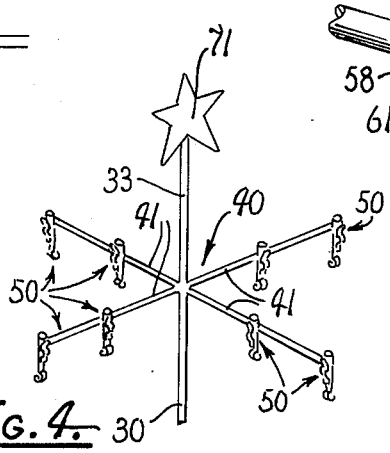
FIG. 4 is a fragmentary perspective view of the crown portion of the assembly.

As can best be seen in FIG. 4, the assembly 10 has a crown portion 40 which is mounted on the remote end portion 33 of the central electric conductor 30. The crown portion is composed of four tertiary cables or crown conductors 41 connected to the central electric conductor and extending in four rightangularly related directions. Each of the crown conductors has a pair of electrically conductive wires 42 extended therethrough and wired to the central electric conductor in parallel.

Figure 5:
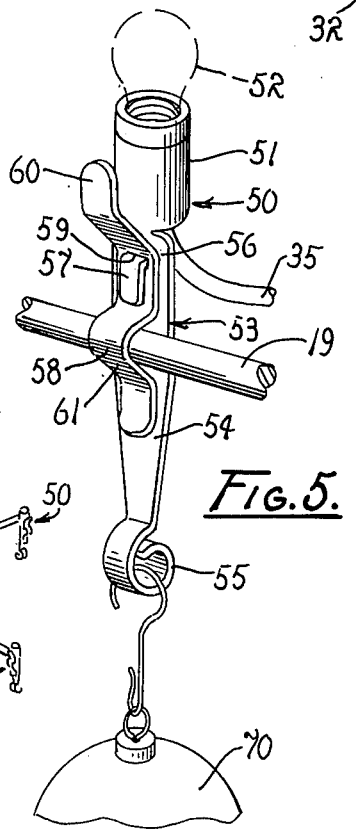
FIG. 5 is a somewhat enlarged fragmentary perspective view of one light and associated fastener of the assembly shown mounted in position on the branch of a tree in supporting relation to an ornament.

A plurality of lamps or lights 50 are borne by the distal portions 36 of the secondary electrical conductors 34, by the crown conductors 41 and by the remote end portion 33 of the central electric conductor. Each light has a light socket 51 wired in electrically conductive relation to its respective wires 34, 37, 38 or 42, as best shown in FIG. 3. Each socket mounts a bulb 52 and has an oppositely extending fastener 53. Each fastener is composed of a body member 54 having a helically bent, or spiral, ornament attaching portion 55 and a proximal branch attaching portion 56. A right-angularly bent spring 57 is secured on the body member at the branch attaching portion thereof. A clip 58 having a passage 59 extended therethrough is mounted on the body member with the spring extending through the passage, as shown in FIG. 5. The clip has a lever portion 60 adjacent to the light socket 51 and an opposite clamp portion 61. The spring operates resiliently to maintain the clamp portion of the clip in engagement with the body member 54. As shown in FIG. 5, an ornament 70 is mounted on the ornament attaching portion 55 of the body member. A top ornament such as indicated at 71 can be attached to the light 50 attached to the extreme upper portion of the trunk.

OPERATION

The operation of the described embodiment of the subject invention is believed to be clearly apparent and is briefly summarized at this point. Beginning with either the remote end portion 33 or the lead end portion 31, the central electric conductor 30 is wound about the trunk 16 of a tree 15, as best shown in FIG. 1. The secondary electric conductors 35 are then individually extended along the branches 19 of the tree toward the periphery 20 thereof and the fasteners 53 of each light 50 attached to the branch, as shown in FIG. 5. Such attachment is accomplished by simply pressing the lever portion 60 of the clip 58 to slide the clamp portion 61 about the branch. Thereafter, the lever portion is released to allow the clamp portion, by action of the spring 57 releasibly to capture the branch between the clamp portion and the body member 54 of the fastener.

It will be apparent that the winding of the central electric conductor 30 about the trunk 16 will dispose the secondary electric conductors 35 in radial extension from the trunk and out of the coplanar relationship with the central electric conductor shown in FIG. 2. Thus, the conductors 35 are available for extension along any branches 19 regardless of their attitude with respect to the trunk for distribution of the lights 50 about the tree.

To provide the most attractive ornamental effect, the lights 50 of each bifurcated distal portion 36 are ordinarily spaced as far as possible from each other so as evenly to mount the lights 50 at or near the periphery 20 of the tree 15. Each light is, of course, attached in substantially right-angular relation to its respective branch 19 so as to be disposed in an upright attitude to display the bulb 52 thereof in upwardly extending relation.

This operation is simply continued the full length of the tree 15 by wrapping the central electric conductor 30 about the tree trunk 16 and attaching the bifurcated distal portions 36 of the secondary electric conductors 35 to the branches 19 as described. The crown portion 40 is attached to the upper portion 18 of the tree by extension of the secondary crown conductors 41 along the branches 19 and the attachment of the fasteners 53 to the branches to mount the lights 50 in the upright attitudes described. The crown portion has four right-angularly related crown conductors, as shown in FIG. 4, so as to match the usual configuration of the crown portions of trees.

Once the assembly 10 is mounted as described and shown in FIG. 1, any desired number of ornaments 70 can be attached individually to the helically bent ornament attaching portions 55 of the fasteners 53, as shown in FIG. 5. This greatly facilitates the attachment of such ornaments to a tree and provides a dependable support with optimum decorative effect. It will be seen that is is unnecessary to attach an ornament to each of the attaching portions 55 since the helically bent construction provides an inherently ornamental appearance which, even if visible, does not detract from the overall appearance of the tree. Furthermore, since the attaching portions extend downwardly relative to the branches 19, the normally drooping attitudes of the branches operate to obsure this structure.

When the tree lighting assembly 10 is mounted as described, the electric plug 32 is simply inserted in the electrical outlet 13 to cause electrical current to flow through the assembly to illuminate the bulbs 52.

Therefore, the tree lighting assembly of the present invention significantly improves the facility with which ornamental decorations can be mounted on a tree inherently achieving the maximum decorative effect by the extension of nonornamental portions thereof along the trunk and branch structure of the tree whereby there are rendered nearly invisible which allows the lights to be evenly distributed about the tree's periphery and which provides dependable and easily usable support for additional ornaments.

Although the invention has been herein shown and described in what is conceived to be the most practical and preferred embodiment, it is recognized that departures may be made therefrom within the scope of the invention, which is not to be limited to the illustrative details disclosed.

Having described my invention, what I claim as new and desire to secure by Letters Patent is:

1. A Christmas tree lighting assembly comprising:

A. a central flexible insulated cable containing a pair of primary conductors and adapted to be wound about the trunk of a Christmas tree;

B. a multiplicity of lateral cables adapted to be extended along limbs of the tree, having inner ends and outer ends and each having a pair of secondary conductors extending therethrough, the secondary conductors being individually connected to the primary conductors at the inner ends of the lateral cables and the lateral cables with the secondary conductors extending therethrough being branched adjacent to the outer ends thereof;

C. a plurality of lights individually electrically connected in parallel to the secondary conductors of each lateral cable at the outer ends thereof;

D. clips individually mounted on the lights releasably engageable with limbs of the tree to support the lights thereon; and E. means borne by each clip for the support of an ornament in depending relation thereon and which is of a substantially spiral configuration for purposes of appearance and the support of an ornament thereon.

* * * * *

UNITED STATES PATENT AND TRADEMARK OFFICE

CERTIFICATE OF CORRECTION

PATENT NO. : 4,012,631

DATED : March 15, 1977

INVENTOR(S) : James J. Creager

It is certified that error appears in the above-identified patent and that said Letters Patent are hereby corrected as shown below:

Column 2, Line 54, after "has" and before "suitably" insert --- a ---.

Column 3, Line 28, delete "rightangularly" and insert --- right-angularly ---.

Column 4, Line 44, delete "is is" and insert --- it is ---.

Signed and Sealed this

Tenth Day of May 1977

[SEAL]

*Attest:*

RUTH C. MASON
*Attesting Officer*

C. MARSHALL DANN
*Commissioner of Patents and Trademarks*